United States Patent [19]

Rodriguez et al.

[11] Patent Number: 4,976,745

[45] Date of Patent: Dec. 11, 1990

[54] PROCESS FOR STABILIZING A HYDROCARBON IN WATER EMULSION AND RESULTING EMULSION PRODUCT

[76] Inventors: Domingo Rodriguez; Lirio Quintero; Maria T. Terrer; Euler Jimenez; Felix Silva; Jose Salazar, all of Apdo. 76343, Caracas 1070A, Venezuela

[21] Appl. No.: 342,148

[22] Filed: Apr. 24, 1989

Related U.S. Application Data

[63] Continuation-in-part of Ser. No. 133,323, Dec. 16, 1987, Pat. No. 4,824,439, Ser. No. 14,871, Feb. 17, 1987, Pat. No. 4,834,775, which is a continuation-in-part of Ser. No. 875,450, Jun. 17, 1986, Pat. No. 4,801,304.

[51] Int. Cl.[5] ..... C10L 1/32

[52] U.S. Cl. ..... 44/301; 252/351; 252/352; 252/354

[58] Field of Search ..... 44/51, 67; 252/351, 252/352, 354

[56] References Cited

U.S. PATENT DOCUMENTS

| | | | |
|---|---|---|---|
| 2,673,145 | 3/1954 | Chander | 44/67 |
| 2,845,338 | 7/1958 | Ryznar et al. | 44/5 |
| 3,078,662 | 2/1963 | Rocchini et al. | 44/67 |
| 3,127,742 | 4/1964 | Niles | 44/67 |
| 3,332,755 | 7/1967 | Kukin | 44/4 |
| 3,380,531 | 4/1968 | McAuliffe et al. | 166/45 |
| 3,467,195 | 9/1969 | McAuliffe et al. | 166/314 |
| 3,519,006 | 7/1970 | Simon et al. | 137/13 |
| 3,807,932 | 4/1974 | Dewald | 431/2 |
| 3,837,820 | 9/1974 | Kukin | 44/5 |
| 3,876,391 | 4/1975 | McCoy et al. | 44/51 |
| 3,880,612 | 4/1975 | Ostergren | 44/67 |
| 3,902,869 | 9/1975 | Friberg et al. | 44/51 |
| 3,943,954 | 3/1976 | Flournoy et al. | 137/13 |
| 4,002,435 | 1/1977 | Wenzel et al. | 44/51 |
| 4,046,519 | 9/1977 | Piotrowski | 44/51 |
| 4,061,473 | 12/1977 | Norris | 44/67 |
| 4,084,940 | 4/1978 | Lissant | 44/51 |
| 4,099,537 | 7/1978 | Kalfoglou et al. | 137/13 |
| 4,108,193 | 8/1978 | Flournoy et al. | 137/13 |
| 4,144,015 | 3/1979 | Berthiaume | 431/8 |
| 4,158,551 | 6/1979 | Feuerman | 44/51 |
| 4,162,143 | 7/1979 | Yount, III | 44/51 |
| 4,226,601 | 10/1980 | Smith | 44/10 D |
| 4,239,052 | 12/1980 | McClaflin | 137/13 |
| 4,315,755 | 4/1982 | Hellsten et al. | 44/51 |
| 4,333,488 | 6/1982 | McClaflin | 137/13 |
| 4,343,323 | 5/1982 | Kessick | 137/13 |
| 4,375,359 | 3/1983 | Chapman et al. | 44/67 |
| 4,379,490 | 4/1983 | Sharp | 166/304 |
| 4,382,802 | 5/1983 | Beinke et al. | 44/51 |
| 4,392,865 | 7/1983 | Grosse et al. | 44/51 |
| 4,416,610 | 11/1983 | Gallagher, Jr. | 431/4 |
| 4,445,908 | 5/1984 | Compere et al. | 44/56 |
| 4,477,258 | 10/1984 | Lepain | 44/51 |
| 4,488,866 | 12/1984 | Schirmer et al. | 431/4 |
| 4,512,774 | 4/1985 | Myers et al. | 44/51 |
| 4,570,656 | 2/1986 | Matlach et al. | 137/13 |
| 4,618,348 | 10/1986 | Hayes et al. | 44/51 |
| 4,627,458 | 12/1986 | Prasad | 137/13 |

FOREIGN PATENT DOCUMENTS

| | | |
|---|---|---|
| 56-159291 | 8/1981 | Japan . |
| 974042 | 11/1964 | United Kingdom . |

*Primary Examiner*—Margaret B. Medley

[57] ABSTRACT

A process for the preparation of stable hydrocarbon in water emulsions employing heavy crudes and bitumens having high viscosities and the resulting viscosity stable emulsion products.

19 Claims, No Drawings

PROCESS FOR STABILIZING A HYDROCARBON IN WATER EMULSION AND RESULTING EMULSION PRODUCT

CROSS REFERENCE TO RELATED APPLICATIONS

This application is a continuation-in-part of Application Ser. No. 133,323, filed Dec. 16, 1987, now U.S. Pat. No. 4,824,439, issued Apr. 24, 1989 which in turn is a continuation-in-part of Application Ser. No. 014,871, filed Feb. 17, 1987, now U.S. Pat. No. 4,834,775, issued May 30, 1989 which in turn is a continuation-in-part of Application Ser. No. 875,450, filed June 17, 1986 U.S. Pat. No. 4,801,304, issued Jan. 31, 1989.

BACKGROUND OF THE INVENTION

The present invention relates to a process for stabilizing hydrocarbon in water emulsions and the resultant viscosity stable hydrocarbon in water emulsion products.

Hydrocarbon in water emulsions which use surfactants to form the emulsion have been employed in the production and transportion of heavy crudes and bitumens having high viscosities. Typical of the foregoing are hydrocarbon in water emulsions disclosed in U.S. Pat. Nos. 3,467,195 and 4,265,264. Due to the physical chemistry of the hydrocarbon-water-surfactant system, the hydrocarbon is water emulsions are subject to aging, that is, a tendency to increase in viscosity over time. Aging is a serious problem when handling hydrocarbon in water emulsions due to the fact that the emulsions must be transported and stored prior to final processing which, in many cases, requires the emulsion to remain stable for up to thirty days or longer. Failure of the emulsions to remain stable results in the coalescence of the disbursed oil droplet phase of the emulsion and correspondingly an increase in viscosity of the emulsion. The coalescence of the oil droplet phase ultimately results in the breaking of the hydrocarbon in water emulsions into separate phases of oil and water.

Naturally, it would highly desirable to develop stable hydrocarbon in water emulsions which maintain stable viscosities over relatively long periods of time thereby allowing for transportion and storage of the hydrocarbon in water emulsions.

Accordingly, it is the principal object of the present invention to provide a process for stabilizing hydrocarbon in water emulsions formed from heavy crude and bitumens having high viscosities.

It is a particular object of the present invention to provide a process as set forth above wherein a stabilizing additive is admixed in the hydrocarbon-water-surfactant system so as to form stabilized hydrocarbon in water emulsion products.

Further objects and advantages of the present invention will appear hereinbelow.

SUMMARY OF THE INVENTION

The present invention relates to a process for the preparation of stable hydrocarbon in water emulsions employing heavy crudes and bitumens having high viscosities and the resulting viscosity stable emulsion products.

It is well known in the art to form oil in water emulsions either from naturally occurring bitumens or residual oil in order to facilitate the production and/or transportion of these viscous hydrocarbons. Typical processes are disclosed in U.S. Pat. Nos. 3,380,531; 3,467,195; 3,519,006; 3,943,954; 4,099,537; 4,108,193; 4,239,052 and 4,570,656. In addition to the foregoing, the prior art teaches that oil in water emulsions formed from naturally occurring bitumens and/or residual oils can be used as combustible fuels. See for example U.S. Pat. Nos. 4,144,015; 4,378,230 and 4,618,348.

The present invention is drawn to a process for stabilizing hydrocarbon in water emulsions of the type set forth above. The process of the present invention comprises forming an oil in water emulsion by admixing a heavy crude or bitumen hydrocarbon characterized by a high viscosity with water and an emulsifier along with a water soluble stabilizing additive of $Al^{+++}$ in a concentration of greater than 30 ppm with respect to the total emulsion volume. It has been found that the additions of $Al^{+++}$ to a hydrocarbon in water emulsion in a concentration of greater than 30 ppm with respect to the total emulsion volume effectively stabilizes hydrocarbon in water emulsions when compared to emulsions to which no $Al^{+++}$ addition has been added. Concentrations of $Al^{+++}$ in an order greater than 1,000 ppm with respect to the total emulsion volume has shown even a greater effect on initially reducing the viscosity of the emulsion; however, the emulsion stability breaks down within a matter of hours, therefore, $Al^{+++}$ additions are preferably no greater than 1,000 ppm. Concentrations of $Al^{+++}$ in the range of less than 30 ppm offer little stabilizing effect on the emulsions. It is preferred in accordance with the present invention that the stabilizing additive of $Al^{+++}$ be present in a concentration of from about 30 to 70 ppm with respect to the total emulsion volume. The $Al^{+++}$ additive as noted above should be introduced in the form of a water soluble addition and a suitable and preferred form is aluminum nitrate. The resulting hydrocarbon in water emulsion product made in accordance with the process of the present invention exhibit substantially stabilized viscosities over a period of at least 30 days. By maintaining stable emulsions it is possible for the hydrocarbon in water emulsions to be transported and stored without fear of breaking into separate oil and water phases.

DETAILED DESCRIPTION

In accordance with the present invention, the process of the present invention is drawn to the preparation of stabilized hydrocarbon in water emulsions and the resulting stable emulsion products.

In accordance with the present invention the heavy crudes and/or bitumens employed in the process of the present invention have the following chemical and physical properties: carbon 78 to 86% by weight, hydrogen 9 to 11% by weight, oxygen 0.2 to 1.3% by weight, nitrogen 0.5 to 0.7% by weight, sulfur 2 to 4.5% by weight, ashes 0.05 to 0.33% by weight, vanadium 50 to 1,000 ppm, nickel 20 to 500 ppm, iron 50 to 60 ppm, sodium 30 to 200 ppm, gravity below 18 API°, viscosity at 122° F. from 1,000 to 51,000 (CST), viscosity at 74° F. from 90,000 to 150,000 (CST), LHV from 15,000 to 19,000 (BTU/LB), and asphaltenes 9 to 15% by weight. In accordance with the present invention, as is known in the prior art, a mixture comprising water and a surfactant emulsifying agent is admixed with the hydrocarbon so as to form a hydrocarbon in water emulsion having a water content of from about 5 to 40 wt. %. The surfactant emulsifying agent is present in a concentration of from about 0.01 to 4 wt. %, preferably 0.1 to 1 wt. % with respect to the hydrocarbon employed in the oil in water emulsion. Some of the processes which may be employed for the formation of the oil in water emulsions are set forth in the related applications referred to hereinabove which are incorporated herein by reference. Suitable surfactant emulsifying agents include emulsifying agents selected from the group consisting of anionic and nonionic surfactants and mixtures thereof, cationic surfactants and mixtures of cationic surfactants and nonionic surfactants. Where the emulsifying agent employed is an anionic surfactant, the preferred anionic surfactants are selected from the group consisting of sulfonic alkyl aryl acid salts, alkyl sulfates or mixtures thereof. Where the surfactants emulsifier is a nonionic surfactant, the preferred nonionic surfactant is selected from the group consisting of polyoxyethylenated alcohols, polyoxyethylenated alkyl phenols and mixtures thereof. The preferred nonionic surfactant is polyoxyethylenated nonyl phenol having at least 20 units of ethylene oxide in a hydrophilic-lipophilic balance of greater than 14. Where the emulsifier is a cationic surfactant, the preferred surfactant is selected from the group consisting of ethoxylated amines, amidoamines, quaternary ammonium compounds and mixtures thereof. As noted above the concentration of emulsifier is from about 0.01 to 4 wt. %, preferably 0.1 to 1 wt. % with respect to the bitumen.

In accordance with the present invention the stabilized hydrocarbon in water emulsion is formed by admixing a hydrocarbon and water with an emulsifier and a water soluble stabilizing additive of $Al^{+++}$ in a concentration of from about 30 to 1,000 ppm, preferably in a concentration of from about 30 to 70 ppm, with respect to the total emulsion volume. The preferred stabilizing additive is aluminum nitrate. It has been found that additions of $Al^{+++}$ in concentrations of less than 30 ppm with respect to the total emulsion volume are not effective in reducing viscosity of the emulsion or maintaining stability thereof while additions greater than 1,000 ppm significantly reduce the viscosity; however, the resulting emulsions break down within a matter of hours.

The advantages of the present invention will be clear from consideration of the following example.

EXAMPLE

In order to demonstrate the effect of the stabilizing additive of the present invention on the aging of hydrocarbon in water emulsions, an oil in water emulsion was formed employing a hydrocarbon having the following chemical and physical properties: carbon 86.0 wt. %, hydrogen 9.0 wt. %, oxygen 0.28 wt. %, nitrogen 0.70 wt. %, sulfur 4.00 wt. %, vanadium 400 ppm, viscosity at 122° F., 50,000 mPas, viscosity at 74° F., 115,000 mPas; API Gravity, 10.

The hydrocarbon was admixed with water and an emulsifier so as to form a hydrocarbon in water emulsion having a water content of 30 wt. %. The emulsifier used in the formation of the oil in water emulsion was polyoxyethylenated nonyl phenol with 17.5 units ethylene oxide and the surfactant was present in a concentration of 0.2 wt. % with respect to the hydrocarbon.

The emulsion was divided into four batches identified as Emulsions 1, 2, 3 and 4. Aluminum nitrate was added to Emulsion 2 in a concentration of 30 ppm with respect to the total emulsion volume. Aluminum nitrate in an amount of 50 ppm with respect to the total emulsion volume was added to Emulsion 3. Emulsion 4 had an addition of 70 ppm aluminum nitrate with respect to the total emulsion volume. The four emulsions were then stored in containers at a temperature of 75° F. and the viscosity of the emulsions were measured on the day of storage, eight days later, and again 30 days later. Table I hereinbelow summarized the emulsion aging data.

TABLE I

| | | 0 Days | | 8 Days | | 30 Days | |
|---|---|---|---|---|---|---|---|
| Emul. | Conc. $Al^{+++}$ (ppm) | Mean Droplet Size (μm) | Viscosity (mPas) | Mean Droplet Size (μm) | Viscosity (mPas) | Mean Droplet Size (μm) | Viscosity (mPas) |
| 1 | 0 | 17 | 3015 | 18 | 30200 | 18 | 35840 |
| 2 | 30 | 16 | 2678 | 17 | 5000 | 18 | 4842 |
| 3 | 50 | 16 | 1878 | 17 | 3124 | 17 | 2980 |
| 4 | 70 | 16 | 235 | 16 | 1800 | 17 | 1750 |

As can be seen from Table I above, additions of $Al^{+++}$ in Emulsions 2, 3 and 4 tended to (1) lower the overall viscosity of the emulsion, and (2) maintain a viscosity stability over Emulsion 1 in which $Al^{+++}$ was not present. The data clearly supports the proposition that additions of $Al^{+++}$ results in emulsion stability.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for stabilizing a hydrocarbon-in-water emulsion comprising forming a hydrocarbon-in-water emulsion by admixing a hydrocarbon selected from the group consisting of heavy crudes and bitumen, having a viscosity at 122° F. of about or greater than or equal to 1,000 (CST) and a viscosity at 74° F. of about or equal to or greater than 9,000 (CST) and an API° gravity below 18, water, an emulsifier and a water soluble stabilizing additive of $Al^{+++}$ in a concentration of greater than 30 ppm with respect to the total emulsion volume.

2. A process according to claim 1 wherein said stabilizing additive is in the form of a water soluble aluminum nitrate compound.

3. A process according to claim 1 wherein said emulsifying agent is present in a concentration of from about 0.01 to 4 wt. % with respect to the hydrocarbon.

4. A process according to claim 3 wherein said emulsifying agent is selected from the group consisting of anionic and nonionic surfactants and mixtures thereof, cationic surfactants and mixtures of cationic surfactants and nonionic surfactants.

5. A process according to claim 4 wherein the emulsifier is an anionic surfactant selected from the group consisting of sulfonic alkyl aryl acid salts, alkyl sulfates or mixtures thereof.

6. A process according to claim 4 wherein said emulsifier is a nonionic surfactant selected from the group consisting of polyoxyethylenated alcohols, polyoxyethylenated alkyl phenols and mixtures thereof.

7. A process according to claim 4 wherein said emulsifier is a cationic surfactant selected from the group consisting of ethoxylated amines, amido-amines, quaternary ammonium compounds and mixtures thereof.

8. A process according to claim 6 wherein said nonionic surfactant is polyoxyethylenated nonyl phenol having at least 20 units of ethylene oxide in a hydrophilic-lipophilic balance of greater than 14.

9. A process according to claim 4 wherein said emulsifier is present in a concentration of from about 0.01 to 1 wt. % with respect to the hydrocarbon.

10. A process according to claim 1 wherein said hydrocarbon has the following chemical and physical properties: carbon 78 to 86% by weight, hydrogen 9 to 11% by weight, oxygen 0.2 to 1.3% by weight, nitrogen 0.5 to 0.7% by weight, sulfur 2 to 4.5% by weight, ashes 0.05 to 0.33% by weight, vanadium 50 to 1,000 ppm, nickel 20 to 500 ppm, iron 50 to 60 ppm, sodium 30 to 200 ppm, viscosity at 122° F. from 1,000 to 51,000 (CST), viscosity at 74° F. from 90,000 to 150,000 (CST), LHV from 15,000 to 19,000 (BTU/LB), and asphaltenes 9 to 15% by weight.

11. A process according to claim 1 wherein said emulsion has a water content of from about 5 to 40 wt. %.

12. A process according to claim 1 wherein said stabilizing additive is present in a concentration of from about 30 to 70 ppm.

13. A hydrocarbon in water emulsion characterized by a stable viscosity comprising a hydrocarbon selected from the group consisting of heavy crudes and bitumens, having a viscosity at 122° F. of about or greater than or equal to 1,000 (CST) and a viscosity at 74° F. of about or equal to or greater than 9,000 (CST) and an API° gravity below 18, water, an emulsifier and a water soluble stabilizing additive of $Al^{+++}$ in a concentration of greater than 30 ppm.

14. A hydrocarbon in water emulsion according to claim 13 wherein the stabilizing additive is present in a concentration of from about 30 to 1,000 ppm.

15. A hydrocarbon in water emulsion according to claim 13 wherein the stabilizing additive is present in a concentration of from about 30 to 70 ppm.

16. A hydrocarbon in water emulsion according to claim 13 wherein said hydrocarbon has the following chemical and physical properties: carbon 78 to 86% by weight, hydrogen 9 to 11% by weight, oxygen 0.2 to 1.3% by weight, nitrogen 0.5 to 0.7% by weight, sulfur 2 to 4.5% by weight, ashes 0.05 to 0.33% by weight, vanadium 50 to 1,000 ppm, nickel 20 to 500 ppm, iron 50 to 60 ppm, sodium 30 to 200 ppm, viscosity at 122° F. from 1,000 to 51,000 (CST), viscosity at 74° F. from 90,000 to 150,000 (CST), LHV from 15,000 to 19,000 (BTU/LB), and asphaltenes 9 to 15% by weight.

17. A hydrocarbon in water emulsion according to claim 13 wherein said emulsifying agent is present in a concentration of from about 0.02 to 4 wt. % with respect to the hydrocarbon.

18. A hydrocarbon in water emulsion according to claim 13 wherein said emulsifier is present in a concentration of from about 0.01 to 1 wt. % with respect to the hydrocarbon.

19. A hydrocarbon in water emulsion according to claim 17 wherein the water content of the emulsion is from about 5 to 40 wt. %.

* * * * *

UNITED STATES PATENT AND TRADEMARK OFFICE

CERTIFICATE OF CORRECTION

PATENT NO. : 4,976,745

DATED : December 11, 1990

INVENTOR(S) : Domingo Rodriguez et al.

It is certified that error appears in the above-identified patent and that said Letters Patent is hereby corrected as shown below:

Column 6, line 26, delete "0.02"
and insert --0.01--

Signed and Sealed this

Fifth Day of January, 1993

*Attest:*

DOUGLAS B. COMER

*Attesting Officer*

*Acting Commissioner of Patents and Trademarks*